US006247625B1

(12) United States Patent
Chakrabarti et al.

(10) Patent No.: US 6,247,625 B1
(45) Date of Patent: Jun. 19, 2001

(54) ANVIL PAD CONFIGURATION FOR LASER CLEAVING

(75) Inventors: Utpal Kumar Chakrabarti, Allentown, PA (US); David Reese Peale, Chatham, NJ (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/080,648

(22) Filed: May 18, 1998

(51) Int. Cl.[7] ..... B26F 3/00

(52) U.S. Cl. ..... 225/96.5; 225/105; 225/103; 225/104

(58) Field of Search ..... 225/94, 96.5, 103, 225/104, 105

(56) References Cited

U.S. PATENT DOCUMENTS 4,463,886 * 8/1984 Thornton .
4,565,310 * 1/1986 Krause .
4,995,539 2/1991 Richard .
5,154,333 10/1992 Bauer et al. .
5,259,925 11/1993 Herrick et al. .
5,272,114 12/1993 Berkum et al. .

* cited by examiner

*Primary Examiner*—George Fourson
*Assistant Examiner*—Joannie A. Garcia
(74) *Attorney, Agent, or Firm*—Wendy W. Koba, Esq.

(57) ABSTRACT

An improved anvil tool for use in laser bar or wafer cleaving comprises a relatively small cross section such that the anvil does not overhang the device edges in any direction. In one embodiment, the surface of the tool contacting the laser wafer or bar is compliant and contains a laterally disposed slit that aligns with the scribe mark on the top surface of the material to be cleaved. The anvil may be formed as a columnar tool or as a film deposited on a substrate. The compliant surface may be removable and in a preferred embodiment may comprise a continuous feed membrane tape so that a "clean" surface is used for each subsequent cleave operation.

9 Claims, 3 Drawing Sheets

ANVIL PAD CONFIGURATION FOR LASER CLEAVING

BACKGROUND OF THE INVENTION

The present invention relates to an anvil pad configuration for use in a laser cleaving process and, more particularly, to a relatively small anvil pad that is designed to not overhang the edges of the wafer or bar during cleaving.

In the manufacture of devices such as semiconductor lasers and amplifiers or superluminant diodes, the initial fabrication steps are performed on a semiconductor wafer containing hundreds of separate devices. After an initial set of processing steps (defined as "wafer level" processing), the wafer is broken into a number of separate rows of devices, where these rows are referred to in the art as "bars". After additional processing of the devices in bar form, it is necessary to break the bar to form the individual optical devices. In conventional optical device processing, the formation of bars and devices is usually performed by a cleaving process. Typically, the cleaving process requires that the wafers or bars be placed on a thin supporting membrane. Tick marks are then placed at the desired locations where the cleave is to be initiated, and a tensile strain is applied to the material to be cleaved in order to initiate crack formation and propagation from the tick mark through the bulk of the material. The tensile strain is generated by a bending moment formed by force and applied to the top and bottom surfaces of the material. One force is generally applied to the side opposite the tick mark using the edge of a "support mandrel" or, alternatively, a knife edge. In the case of the support mandrel, the force applied to the side carrying the tick mark is generated by a pair of rolling wheels that straddle the edge of the support mandrel and press on the material to be cleaved at or near the edges of the final pieces being cleaved. In the case of knife edge breaking, the force applied to the side carrying the tick mark is generated by a flat anvil pad which is slightly compliant so that the pad can accommodate the bending strain that is generated in the material to be cleaved when the pad presses the material against the knife edge. In both of these systems, there is potential for damage and contamination of the top edge of the facet of the device being cleaved due to contact of the cleaving device with the top surface at or near the device's edge.

An exemplary embodiment of the present invention utilizes an anvil pad including a centrally disposed slit, where this slit will align with a top surface scribe mark during cleaving. The slit in the pad allows the generation of a specified applied bending moment with a lower applied force than a non-slit pad. The optimal dimensions of the slit depend on the width, thickness and material being cleaved, and to a lesser extent the radius of curvature of the pressure edge below the device. The lower force required to initiate cleaving is advantageous since the smaller force means there is less elastic energy stored in the material prior to crack formation, and therefore less energy to be dissipated in the device after the cleave process has absorbed the small amount of energy needed to split the crystal planes.

In one form, the anvil of the present invention may comprise a tool steel upper portion and a compliant lower portion, where the compliant portion contacts the device surface. Alternatively, a membrane tape may be disposed between the anvil and the device, with the tape advancing after each cleaving operation so as to carry away any possible debris from one cleave and present a "clean" compliant surface for each subsequent cleave.

Other and further advantages of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
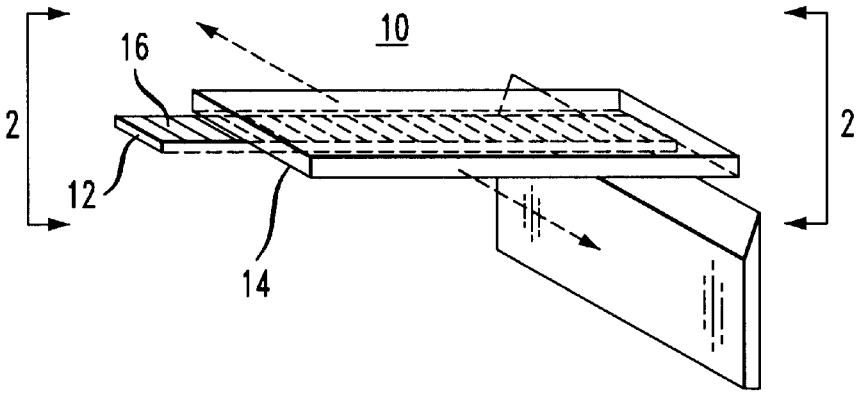
FIG. 1 PRIOR ART
FIG. 1 illustrates a conventional prior art anvil used for cleaving optical devices from a wafer or bar of such devices, with an exemplary laser bar disposed underneath the anvil.

An exemplary prior art anvil pad 10 is illustrated in FIG. 1. A laser bar 12 is shown as disposed underneath pad 10 in a manner such that bottom surface 14 of pad 10 is in contact with top surface 16 of laser bar 12. In some arrangements, a relatively thin membrane (shown in FIG. 2) may be placed between anvil pad 10 and laser bar 12 to protect bar 12 from coming into direct contact with the anvil pad. As is well-known in the art, a laser bar such as that shown in FIG. 1 is cleaved into individual semiconductor optical devices by placing scribe marks on the top surface of the laser bar at "cleave locations", then striking the bottom surface of the bar with a cleaving tool, where the bar is struck directly under the scribe mark locations. Anvil pad 10 is used to exert a downward force in opposition to the striking force applied by the cleaving tool so as to allow the formation of a bending moment needed to form and propagate the cleavage crack through the thickness of the bar.

Figure 2:
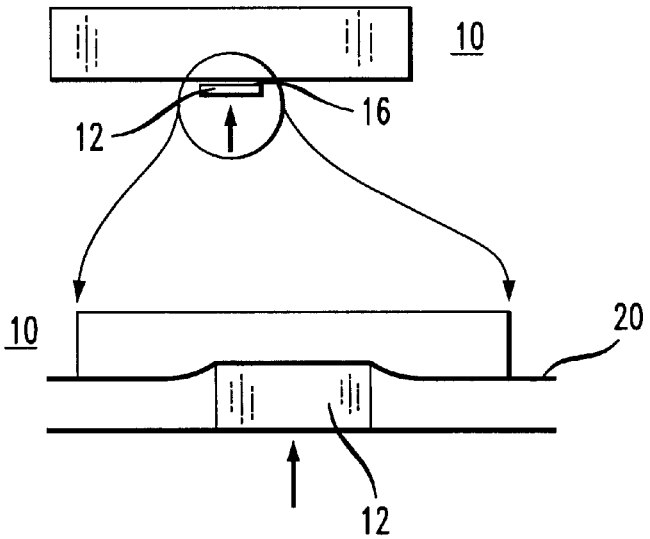
FIG. 2 PRIOR ART
FIG. 2 is an end view of a prior art anvil pad, taken along line 2—2 of FIG. 1, illustrating in particular the deformation of the anvil pad and underlying membrane around the edges of the bar.

In conventional laser bar cleaving systems, anvil pad 10 comprises a relatively compliant material (urethane, for example) so that the pad can accommodate the bending of the laser bar during cleaving. FIG. 2 is an end view of the prior art arrangement of FIG. 1, illustrating in particular the deformation of anvil pad 10 with respect to top surface 16 of laser bar 12. A protective membrane 20 is shown in this view. Unfortunately, the "wrap around" of anvil pad 10 with respect to laser bar 12 provides an opportunity for debris from the pad—and/or the membrane—to transfer to the laser facets.

Figure 3:
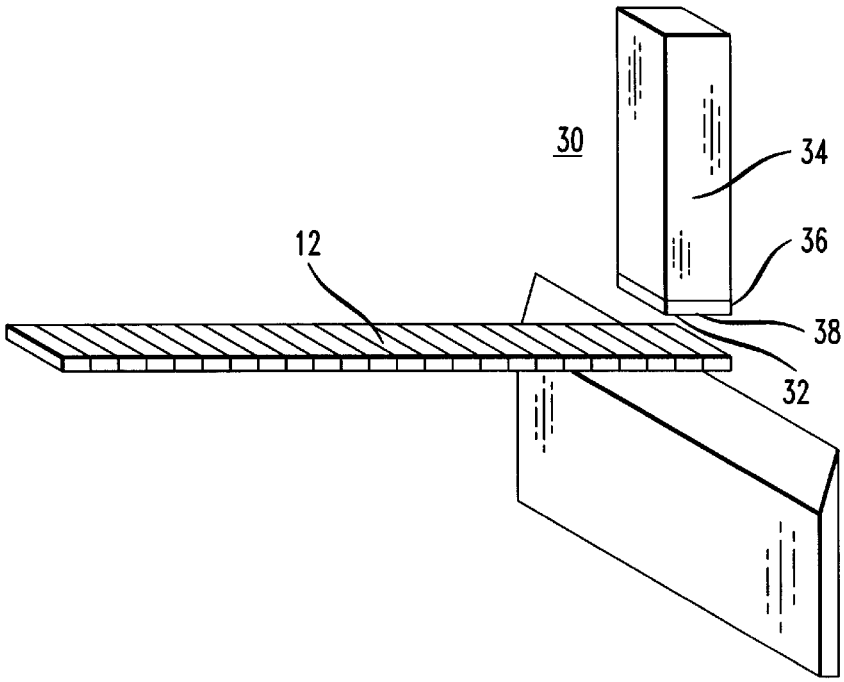
FIG. 3 illustrates an exemplary embodiment of an anvil pad formed in accordance with the present invention, the embodiment of FIG. 3 illustrating a columnar anvil pad with a slit over the region where the cleave will form.

FIG. 3 illustrates an exemplary anvil 30 of the present invention that avoids the contamination problem of the prior art. As shown, anvil 30 comprises a columnar member having a bottom surface 32 of a width w slightly less than the width of a pair of devices to be cleaved and a depth d slightly less than the length of the devices to be cleaved.

Anvil 30 may comprise an upper portion 34 of a rigid material, such as a tool steel and a lower portion 36 of an appropriate thickness of a more compliant material, such as polyimide, polymethylmethacrylate, urethane, or vinyl. Compliant portion 36 is preferably formed to include a centrally disposed slit 38, where slit 38 will align with the scribe mark during the cleaving process. As mentioned above, slit 38 allows for the generation of a specified applied bending moment with a lower applied force than a non-slit pad. The optimal dimensions of the slit depend on the width, thickness and type of material being cleaved and, to a lesser extent, on the radius of curvature of the pressure edge below the material. The lower force required to initiate cleaving when using an anvil including a slit in the compliant portion is advantageous, since the smaller force means there is less elastic energy stored in the material prior to crack formation and, therefore, less energy to be dissipated in the device after the cleave process has absorbed the small amount of energy needed to split the crystal plane. In operation, anvil 30 is positioned to straddle a pair of adjacent devices (as visible by the scribe mark formed as a device delineation marking on the top surface of the laser bar), with slit 38 (if present) aligning with the scribe mark. An exemplary cleaving tool (not shown) is then used to strike the underside of the laser bar directly under the scribe mark. Since lower portion 36 of anvil 30 does not overhang laser bar 12 in either dimension (width or depth), there is no opportunity for portion 36 to deform over the device edges and transfer debris to the laser facet.

Figure 4:
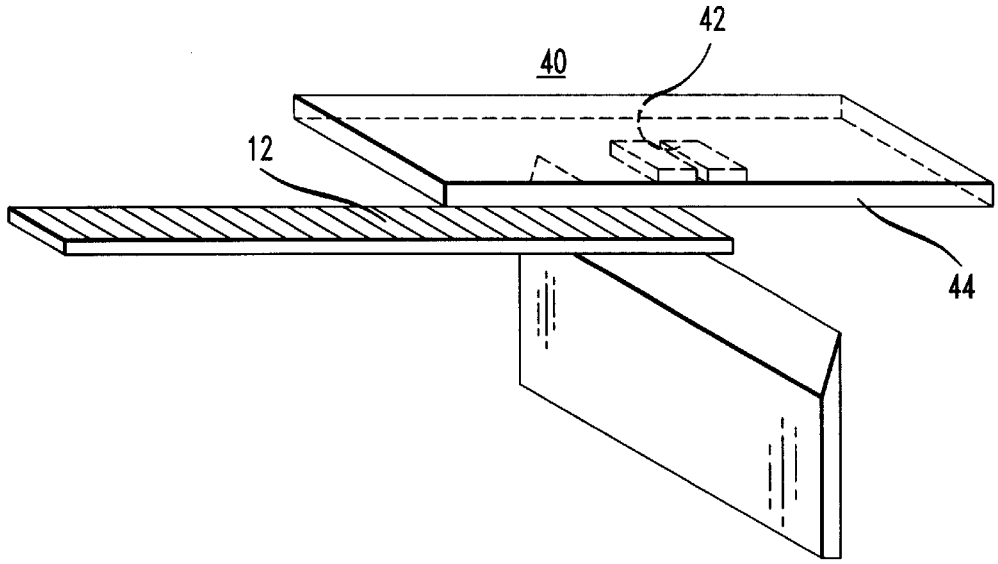
FIG. 4 illustrates an alternative embodiment of the present invention, in particular, an anvil pad formed as a patterned film deposited on a substrate.

An alternative anvil arrangement 40 of the present invention is illustrated in FIG. 4. In this particular embodiment, the compliant portion of the anvil comprises a film 42, such as polymethylmethacrylate, polyimide, etc., deposited on a substrate 44. Preferably, substrate 44 is transparent so that film 42 may be properly aligned with an underlying set of devices to be cleaved. As with the embodiment of FIG. 3, the dimensions of film 42 are well-controlled so that the width w and depth d of the patterned film are slightly smaller than the corresponding dimensions of the devices being cleaved.

Figure 5:
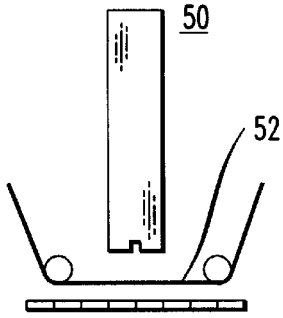
FIG. 5 illustrates an alternative embodiment of the present invention using a membrane tape in association with the anvil.
Figure 6:
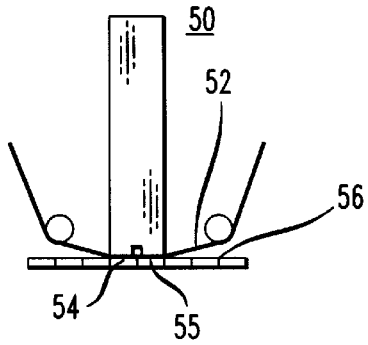
FIG. 6 is another view of the embodiment of FIG. 5, illustrating the anvil pressing down through the continuous tape membrane to create a limited contact area defined by the anvil.
Figure 7:
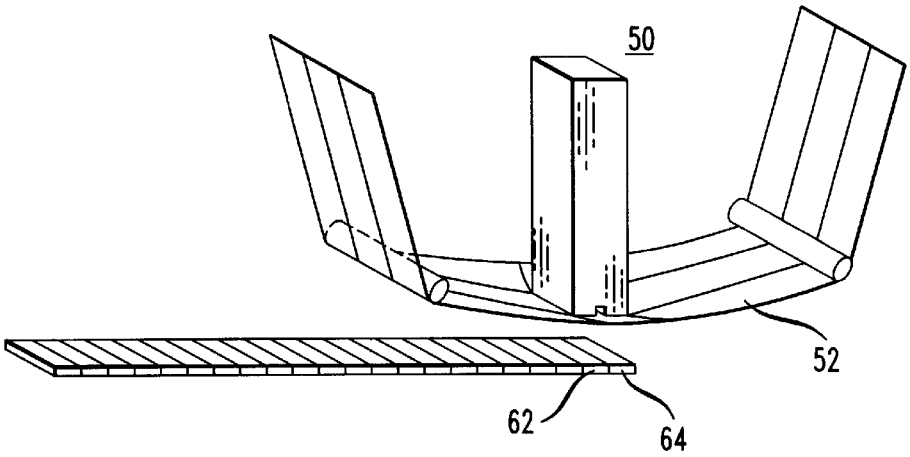
FIG. 7 is yet another view of the embodiment of FIG. 5, illustrating the warping of the continuous tape.

FIG. 5 illustrates an alternative arrangement of the present invention including a columnar anvil 50 that utilizes a replaceable compliant membrane 52. It is well known in the art that it is important to keep the anvil free of debris produced during the cleaving process. Such debris might disturb the uniformity of pressure applied to the devices, or contaminate the device surfaces. The conventional practice of the prior art sometimes places a thin membrane between the anvil and the devices to protect the anvil. However, this membrane, being larger than the devices, is the root of some of the contamination issues addressed by the present invention. In the arrangement as shown in FIG. 5, compliant membrane 52 comprises a membrane tape that is advanced after each cleaving operation so as to present a fresh compliant member for each subsequent cleave. FIG. 6 illustrates the arrangement of FIG. 5 with anvil 50 in the lowered position such that membrane tape 52 is in contact with top surfaces 56 of devices 54 and 55. Since membrane 52 is stretched as anvil 50 presses down into it, only that portion of membrane 52 defined by the size of anvil 50 is brought into contact with the top edges of devices 54,55. FIG. 7 is an alternative view of the arrangement of FIGS. 5 and 6, illustrate how membrane 52 stretches to conform to both dimensions w and d of anvil 50, thereby preventing contamination of device facets 62,64, even though the tape membrane is substantially wider than devices of the exemplary bar.

It is to be understood that there are various other modifications that may be used with the anvil configuration of the present invention and are considered to fall within the spirit and scope of the present invention. Such modifications include, but are not limited to, the materials used to form the anvil and compliant surface associated therewith.

What is claimed is:

1. An apparatus comprising anvil tool for cleaving semiconductor optical material into individual sections, said anvil tool including a first surface for contacting the optical material to effectuate the cleave, said first surface comprising a width approximately equal to twice the width of the individual sections and a depth approximately less than or equal to the depth of the sections.

2. An apparatus comprising anvil tool as defined in claim 1 wherein the first surface of said tool comprises a compliant material.

3. An apparatus comprising anvil tool as defined in claim 2 wherein the compliant material is selected from the group consisting of polyimide, polymethylmethacrylate, urethane and vinyl.

4. An apparatus comprising anvil tool as defined in claim 1 wherein the anvil first surface includes a centrally disposed slot extending across the depth of said anvil.

5. An apparatus comprising anvil tool as defined in claim 1 wherein the anvil comprises a columnar geometry.

6. An apparatus comprising anvil tool as defined in claim 2 wherein the anvil comprises a compliant portion disposed on a substrate surface, said compliant portion comprising a width approximately less than or equal to twice the width of the individual sections and a depth approximately less than or equal to the depth of the material.

7. An apparatus comprising anvil tool as defined in claim 6 wherein the substrate comprises a transparent material.

8. An apparatus comprising anvil tool as defined in claim 2 wherein the compliant first surface is replaceable.

9. An apparatus comprising anvil tool as defined in claim 8 wherein the replaceable first surface comprises a continuous feed membrane tape disposed to contact the underside of the anvil.

* * * * *